US006067880A

United States Patent [19]

Arrigoni

[11] Patent Number: 6,067,880

[45] Date of Patent: May 30, 2000

[54] DEBURRING DEVICE

[76] Inventor: John P. Arrigoni, 18 Martin Trail, Wallingford, Conn. 06492

[21] Appl. No.: 08/984,202

[22] Filed: Dec. 3, 1997

Related U.S. Application Data

[60] Provisional application No. 60/032,281, Dec. 3, 1996.

[51] Int. Cl.[7] ..... B21K 17/00; B24D 15/08; B26B 3/00

[52] U.S. Cl. ..... 76/83; 76/82; 76/88; 30/169; 30/293; 409/301; 409/303

[58] Field of Search ..... 76/82, 82.1, 82.2, 76/83, 88, 84; 29/76.1, 76.4, 77; 451/555, 553, 558; 407/79.1, 79.11, 79.15, 113; 30/280, 293, 294, 337, 339, 342, 344, 188, 191, 193, 169; 409/301, 303, 297, 298

[56] References Cited

U.S. PATENT DOCUMENTS

| | | | |
|---|---|---|---|
| Re. 15,001 | 12/1920 | Berghman | 451/558 |
| 615,956 | 12/1898 | Broadbooks | 30/188 |
| 1,173,627 | 2/1916 | Whitcomb . | |
| 2,092,831 | 9/1937 | Cannon . | |
| 2,428,473 | 10/1947 | Slocum . | |
| 2,515,469 | 7/1950 | Power | 407/29.15 |
| 2,542,281 | 2/1951 | Lefteruk . | |
| 3,501,821 | 3/1970 | Ford | 407/29.15 |
| 4,731,957 | 3/1988 | Weisinger | 76/88 X |
| 4,815,240 | 3/1989 | Larson . | |
| 4,868,986 | 9/1989 | Olson et al. | 30/188 X |
| 4,882,953 | 11/1989 | Kalka . | |
| 5,042,127 | 8/1991 | Lamas | 76/83 X |
| 5,445,050 | 8/1995 | Owens . | |
| 5,499,556 | 3/1996 | Exner et al. . | |
| 5,569,064 | 10/1996 | Gleadall | 76/88 X |

*Primary Examiner*—Rinaldi I. Rada
*Assistant Examiner*—Boyer Ashley

[57] ABSTRACT

A device for removing burrs created on the lateral edges of ice skate blades during sharpening is provided. The device consists includes cutting insert of extremely hard alloy having at least one angled cutting surface. The cutting insert is secured in a recess located along one of the edges of a substantially flat rigid housing member such that the portion of the cutting insert having the cutting surface extends out from the housing member. The housing member is connected to a substantially flat rigid base member such that a channel is defined by a portion of the base member, the end of the housing member having the recess, and the portion of the cutting insert which extends out from the housing member. The housing member and base member are connected such that they may pivot slightly relative to each other, but remain substantially parallel. A positioning screw is threaded through the portion of the base member which defines the channel such that tightening the positioning screw while an ice skate blade is disposed in the channel causes the housing member to pivot relative to the base member and become parallel therewith.

20 Claims, 2 Drawing Sheets

DEBURRING DEVICE

This application claims benefit of Provisional application Ser. No. 60/032,281 filed Dec. 3, 1996.

FIELD OF THE INVENTION

The present invention relates to deburring devices, and more particularly to a hand-held deburring device for removing burrs from ice skate blades after they are sharpened.

BACKGROUND OF THE INVENTION

The passage of hardened steel blades over ice dulls blades made of even the best grades of steel and resharpening is frequently necessary. Typically ice skate blades are sharpened by machining or grinding the blade edges on a milling machine or a grinding machine, respectively, or by manually passing hand-held sharpening tools, or honing stones, repeatedly over the blade face. Regardless of the sharpening method, burrs often form along the lateral edges of the blade. These burrs may be dangerous to the ice skater wearing the skates or other skaters because the burrs are usually jagged and sharp, and they may cause serious injuries. In addition, the presence of burrs on the blade edges decreases the speed the skater may attain and may cause problems with the skater's control. Thus, it is desirable to remove burrs from the edges of skate blades.

A number of hand-held devices for treating blade edges have been developed, including devices which merely sharpen blades and devices which both sharpen and deburr blades.

U.S. Pat. Nos. 1,173,627 to Whitcomb, 2,092,831 to Cannon, 2,428,473 to Slocum, and 4,882,953 to Kalka disclose blade sharpening devices.

Whitcomb '627 discloses a blade sharpener, specifically directed toward knife blades, which consists of two members having a number of cooperating fingers, each finger having a roughened inner face. The fingers are arranged in a staggered relation relative to each other and are forced to engage each other, creating a V-shaped configuration. A knife blade is inserted between the members at the point the fingers engage and the blade is reciprocated transversely of the fingers until the knife had been sharpened sufficiently. A disadvantage of Whitcomb '627 is that the device disclosed therein may not be used to sharpen ice skate blades because the device is designed to sharpen blades to a point. Ice skate blades, however, are sharpened such that the face of the blade is either planar or concave.

Cannon '831 and Slocum '473 both disclose blade sharpening devices directed specifically toward ice skate blades. Both prior art devices are essentially housings for sharpening stones, the basic difference being that in the Slocum '473 device, the sharpening stone is positioned such that blades having a planar face may be sharpened, while in the Cannon '831 device, the sharpening stone is positioned for sharpening blades having a concave face. To sharpen a blade using either prior art device, one must simply insert the blade into a provided channel so that the blade contacts the sharpening stone, press the stone against the blade, and reciprocate the device transversely of the blade. A disadvantage of the devices disclosed in Cannon '831 and Slocum '473 is that although both devices my create burrs along the edges of blades being sharpened, neither device provides for removing the burrs.

The device disclosed in Kalka '953 is a sharpener for the steel strips along the edges of the bottom surfaces of skis.

The device consists of a base with a wall extending perpendicular from the base, and an alloy cutting insert mounted in a recess at the end of the junction of the base and the wall. During operation the base is positioned to slide along the bottom of the ski, thus providing a guide for the device, while a surface of the cutting insert is pressed against the face of the steel strip to be sharpened. The device is then moved along the edge of the ski so that the cutting insert can dig into the steel strip, thus shaving off a thin layer of the strip and sharpening it. A disadvantage of the Kalka '953 device is that, like the devices disclosed in Cannon '831 and Slocum '473, the device only sharpens and may even create burrs, but does nothing to remove them. A further disadvantage is that, even if one attempted to use the device to remove burrs along the edges of an ice skate blade, the device would dig into the sides of the blade and shave off a layer thereof, thereby reducing the thickness of the blade, an undesirable result.

U.S. Pat. Nos. 2,542,281 to Lefteruk, 4,815,240 to Larson, 5,445,050 to Owens, and 5,499,556 to Exner et al. disclose ice skate blade sharpeners which also provide for the removal of burrs along the edges of the blade.

Lefteruk '281 discloses an ice skate blade sharpening device which houses an elongated honing stone. In order to remove burrs created during sharpening, a set screw holding the honing stone in place is loosened and the stone is shifted such that a portion of the stone extends out of the device. The exposed portion of the stone is moved across the edge of the blade to remove burrs. A disadvantage of Lefteruk '281 is that the invention disclosed therein does not provide a channel or guide for the blade during deburring. The operator may therefore hold the device such that the honing stone is not pressed flat against the side of the blade when removing burrs, thereby grinding off the sharp edge at the junction of the side and face of the blade. Even if the honing stone is pressed flat against the sides of the blade, the deburring operation using a honing stone may grind off part of the side of the blade, thus reducing the thickness thereof. Another disadvantage of this prior art is that the device contains relatively many and varied components, which may make the device costly to manufacture and prone to mechanical failure. A further disadvantage of Lefteruk '281 is that the device is designed for both sharpening and deburring, thus requiring the operator to expend money on the sharpening elements of the device even if only a deburring device is desired, as would be the case if a milling or grinding machine were used to sharpen the blade.

Larson '240 discloses an ice skate blade sharpener which provides for a honing surface disposed to facilitate the removal of burrs. The device has two channels, one for housing a honing stone positioned for sharpening and the other for housing a honing stone positioned for deburring. The sharpening channel is defined by two parallel facing surfaces of the housing, with the bottom of the channel being a convex honing stone for sharpening blades having a concave face. The deburring channel is defined by the housing on the bottom and on one parallel side, with the other parallel side being defined by a honing stone. Deburring is accomplished by inserting the blade into the deburring channel, the width of which is greater than the width of the blade, pressing the stone against the side of the blade, and reciprocating the device transversely of the blade. A disadvantage of Larson '240 is that the invention disclosed therein does not provide an adjustable channel or guide for blades of differing thicknesses. During deburring, the operator may therefore hold the device such that the honing stone is not pressed flat against the side of the blade, thereby grinding off the sharp edge at the junction of the sides and face of the blade. Even if the honing stone is pressed flat against the sides of the blade, the deburring operation using a honing stone may grind off part of the side of the blade, thus reducing the thickness thereof. Another disadvantage of this prior art device is that the honing stones are not replaceable, and once they become worn, the entire device must be replaced. Yet another disadvantage of Larson '240 is that the device is designed for both sharpening and deburring, thus requiring the operator to expend money on the sharpening elements of the device even if only a deburring device is desired, as would be the case if a milling or grinding machine were used to sharpen the blade.

Owens '050 and Exner et al. '556 disclose sharpening and deburring devices for ice skate blades. The Owens '050 device has only one channel for sharpening and deburring, which is defined by two parallel facing honing stones, with the bottom of the channel defined by a convex honing stone. Sharpening and deburring is thus accomplished in one step. The device disclosed in Exner et al. '556 has two channels, one for housing a honing stone positioned for sharpening and the other for housing two honing stones positioned for deburring. The sharpening channel is defined by two parallel facing surfaces of the housing, with the bottom of the channel being a cylindrical honing stone for sharpening blades having a concave face. The deburring channel is defined by two parallel facing surfaces of honing stones, with the bottom of the channel being left open. Deburring in both devices is accomplished by inserting the blade into the deburring channel, the width of which is slightly greater than the width of the blade, pressing the sides of the device together to press the honing stones against the sides of the blade, and reciprocating the device transversely of the blade. A disadvantage of both Owens '050 and Exner et al. '556 is that by applying pressure to the honing stones during the deburring operation, the stones may grind off part of the sides of the blade, thus reducing the thickness thereof. Another disadvantage of both devices is that once the honing stones become worn, the entire device must be replaced, as the honing stones may not be replaced. A further disadvantage of the two prior art devices is that they are designed for both sharpening and deburring, thus requiring the operator to expend money on the sharpening elements of the device even if only a deburring device is desired, as would be the case if a milling or grinding machine were used to sharpen the blade.

What is desired, therefore, is a device for deburring ice skate blades which deburrs the blade without reducing the thickness thereof, which is adjustable to accommodate blades of various thicknesses, which deburrs the blade without dulling the sharp edge of the blade at the junction of the blade's side and face, which is inexpensive to produce, and which contains replaceable parts so that worn components may be replaced without requiring replacement of the entire device.

SUMMARY OF THE INVENTION

Accordingly, it is an object of the invention to provide a device for removing burrs from ice skate blades after they are sharpened.

Another object of the invention is to provide a device of the above character which is inexpensive to manufacture.

A further object of the invention is to provide a device of the above character which contains replaceable parts so that worn components may be replaced without requiring replacement of the entire device.

Yet another object of the invention is to provide a device of the above character which deburrs the blade without reducing the thickness of the thereof.

A further object of the invention is to provide a deburring device that can be used to deburr various types of ice skate blades including speedskate, hockey skate and figure skate blades.

Still a further object of the invention is to provide a device of the above character which deburrs the blade without dulling the sharp edge of the blade at the junction of the blade's sides and face.

These and other objects of the invention are achieved by provision of a device for removing burrs created on the lateral edges of ice skate blades during sharpening. The device includes a cutting insert of extremely hard alloy having at least one angled cutting surface. The cutting insert is secured in a recess located along one of the edges of a substantially flat rigid housing member such that the portion of the cutting insert having the cutting surface extends out from the housing member. The housing member is connected to a substantially flat rigid base member such that a channel is defined by a portion of the base member, the end of the housing member having the recess, and the portion of the cutting insert which extends out from the housing member. The housing member and base member are connected such that they may pivot slightly relative to each other, but remain substantially parallel. A positioning screw is threaded through the portion of the base member which defines the channel such that tightening the positioning screw while an ice skate blade is disposed in the channel causes the housing member to pivot relative to the base member and become parallel therewith.

Preferably, the cutting insert has square top and bottom surfaces which are parallel to each other, with the top surface having slightly shorter sides and positioned such that a cross section parallel to the top and bottom surfaces taken anywhere on the insert is square. Also, the recess in the housing member is preferably positioned such that a plane defined by the end of the housing member is parallel to the diagonal of the square top and bottom surfaces of the cutting insert. The housing and base members are preferably connected by a rectangular piece of resilient plastic material. The resilient plastic material is preferably connected to the housing member proximate the end thereof by two screws which pass through holes near and end of the resilient plastic material and the housing member and are fixed in place by corresponding washers and nuts. The holes in the housing member are preferably positioned such that the washers secure the cutting insert tightly in place in the recess. The resilient plastic material is secured to the base member by two screws which pass through holes in the resilient plastic material near the end opposite the first pair of holes and are fixed in place by the screw threads engaging corresponding holes in the base member.

The invention and its particular features and advantages will become more apparent from the following detailed description considered with reference to the accompanying drawings.

DETAILED DESCRIPTION OF THE INVENTION

Figure 1:
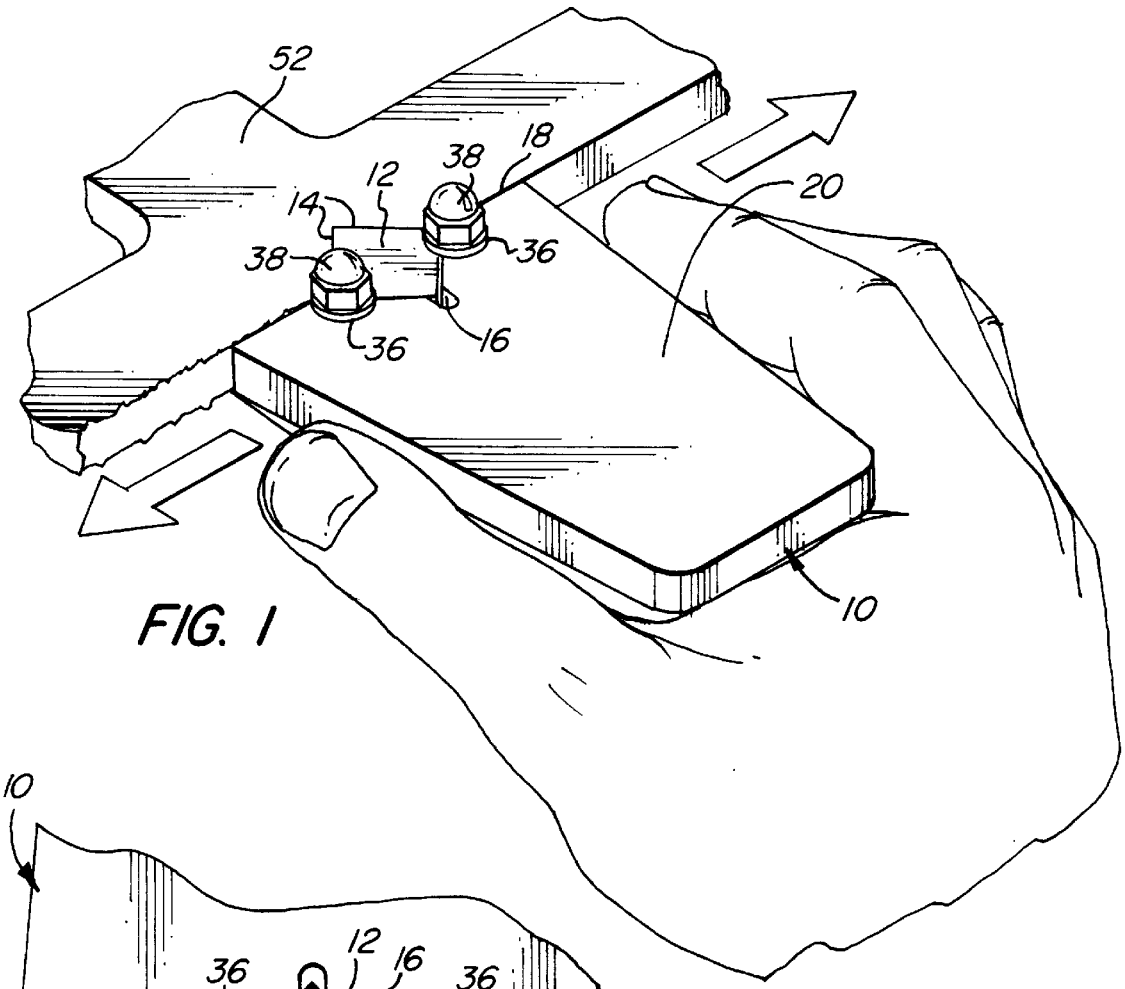
FIG. 1 is a perspective view of a deburring device in accordance with the invention as it would appear in use on the blade of an ice skate.
Figure 3:
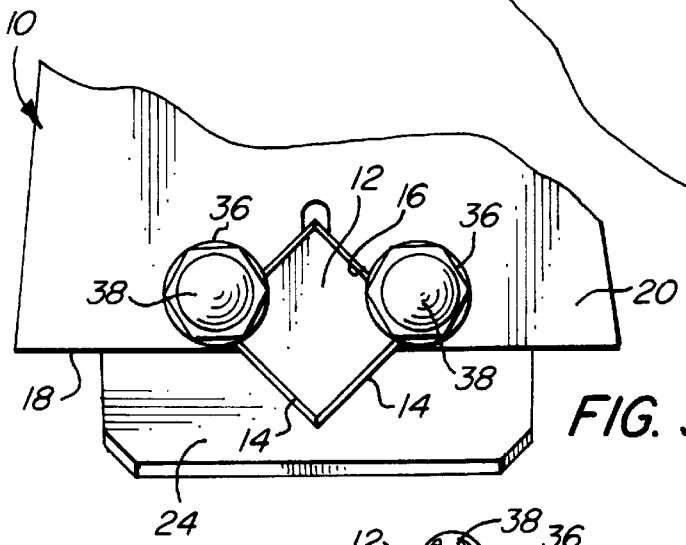
FIG. 3 is a partial top view of the deburring device of FIG. 1.

Referring to FIGS. 1 through 5, a deburring device 10 in accordance with the present invention is shown. A cutting insert 12 of extremely hard alloy, such as Tungsten carbide, is provided. The cutting insert 12 has at least one angled cutting surface 14 and is disposed in a recess 16 located along one of the edges 18 of a substantially flat rigid housing member 20 such that the portion of the cutting insert 12 having the cutting surface 14 extends out from the housing member 20. The housing member 20 is generally rectangular in shape, but may be trapazoidal shaped (as in the figures) or any other shape which is comfortable for the operator of the device 10. The recess 16 is dimensioned such that the cutting insert 12 fits snugly therein, and is substantially the same depth as the thickness of the cutting insert 12. A portion of the recess 16, however, extends through the thickness of the housing member 20 to create an area 22 into which chips of removed burrs may accumulate so that the chips will not interfere with operation of the deburring device 10.

Preferably, the cutting insert 12 has square top and bottom surfaces which are parallel to each other, with the top surface having slightly shorter sides and positioned relative to the bottom surface such that a cross section parallel to the top and bottom surfaces taken anywhere on the cutting insert 12 is square. Such a configuration assures that the cutting insert 12 has four cutting surfaces 14, each angled to the same degree A. It is also preferable that the recess 16 in the housing member 20 is positioned such that a plane defined by the edge 18 of the housing member 20 is parallel to the diagonal of the square top and bottom surfaces of the cutting insert 12 so that once the two exposed cutting surfaces 14 have become worn, the cutting insert 12 may be rotated 90 degrees to expose two unused areas of portions of cutting surfaces 14.

The housing member 20 is connected to a substantially flat rigid base member 24 such that a channel 26 is defined by a portion of the base member 24, the edge 18 of the housing member 20 having the recess 16, and the portion of the cutting insert 12 which extends out from the housing member 20. The housing member 20 and the base member 24 are connected such that they may pivot slightly relative to each other, but remain substantially parallel. The channel 26 is slightly wider than common ice skate blades, and in order to create the channel 26, a portion of the base member 24 extends out past the edge 18 of the housing member 20.

Figure 2:
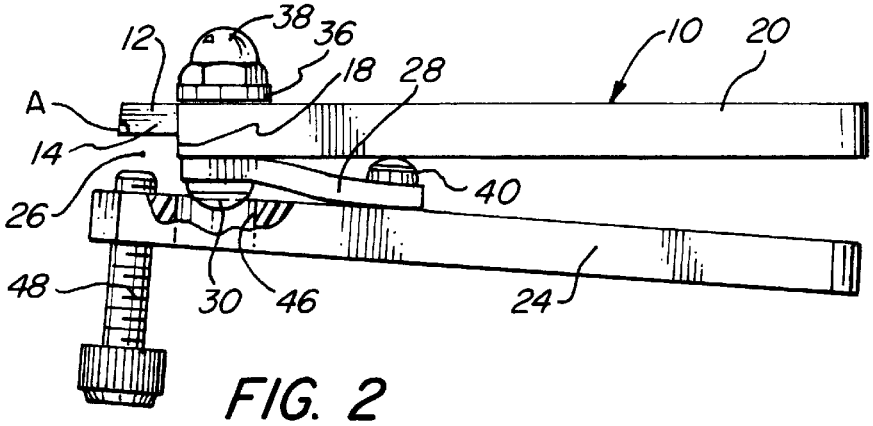
FIG. 2 is a partially cross-sectional side view of the deburring device of FIG. 1.
Figure 4:
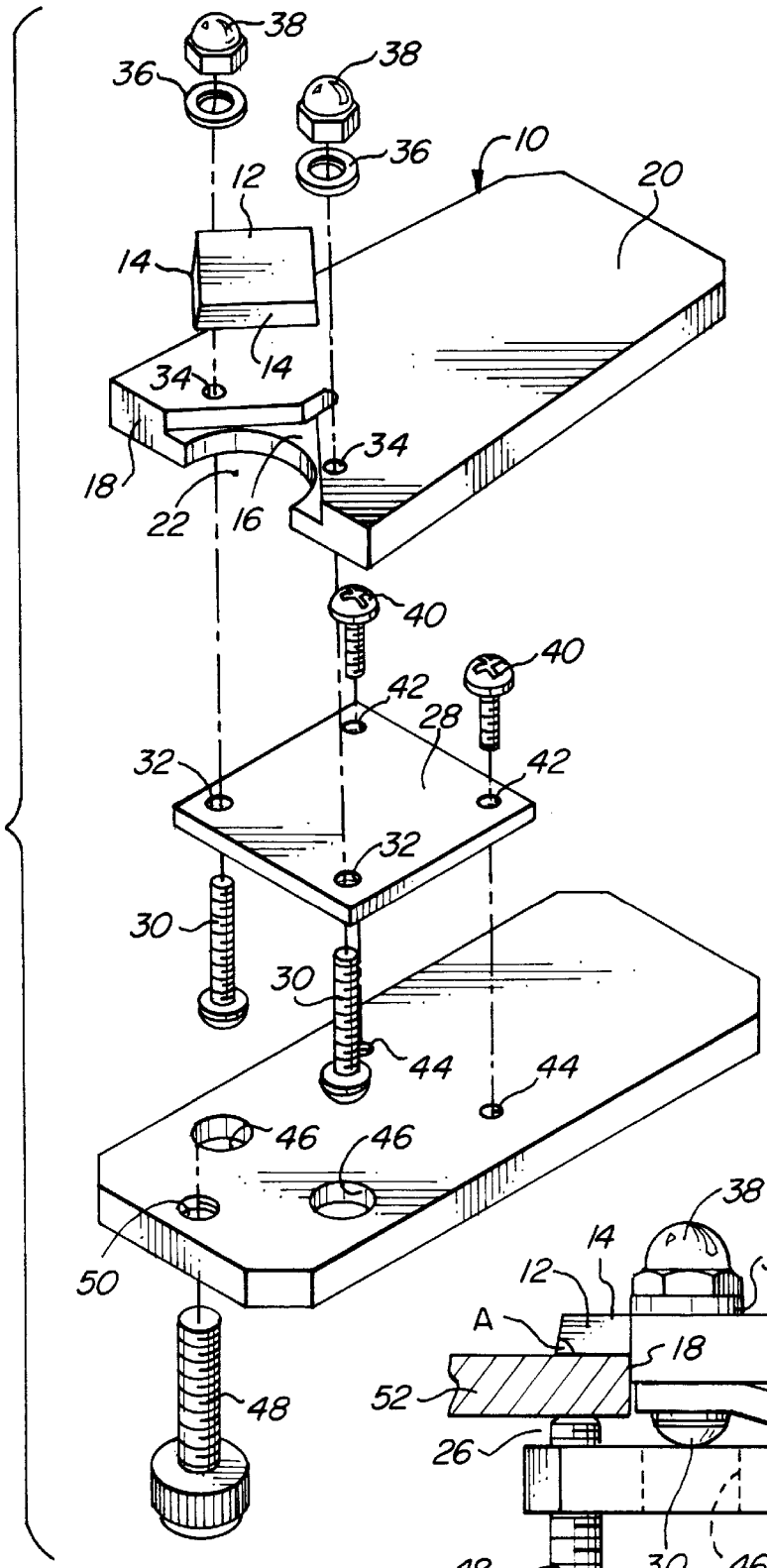
FIG. 4 is an exploded perspective view of the deburring device of FIG. 1.

Preferably, the housing member 20 and the base member 24 are connected by a substantially rectangular piece of resilient plastic material 28. The resilient plastic material 28 is connected to the housing member 20 proximate the edge 18 thereof by two screws 30 which pass through holes 32 near the edge of the resilient plastic material 28 and anchored into corresponding holes 34 near the edge 18 of the housing member 20 by washers 36 and nuts 38. The holes 34 in the housing member 20 are preferably positioned such that the washers 36 secure the cutting insert 12 in place in the recess 16. The resilient plastic material 28 is connected to the base member 24 by two screws 40 which pass through holes 42 near the edge of the resilient plastic material 28 opposite the first holes 32. The screws 40 are anchored into corresponding holes 44 in the base member 24. In order to construct the device 10, and allow the housing member 20 and the base member 24 to pivot relative to each other, holes 46 are provided in the base member 24 corresponding to the position of screws 30 such that the base member 24 does not interfere with the heads of screws 30 (as illustrated in FIG. 2).

A positioning screw 48 is threaded through a hole 50 in the portion of the base member 24 which defines the channel 26 such that tightening the positioning screw 48 while an ice skate blade 52 is disposed in the channel 26 causes the housing member 20 to pivot relative to the base member 24. The positioning screw 48 is preferably plastic or some other non-abrasive, low friction material so that during operation, friction is reduced and the blade 52 is not damaged.

Figure 5:
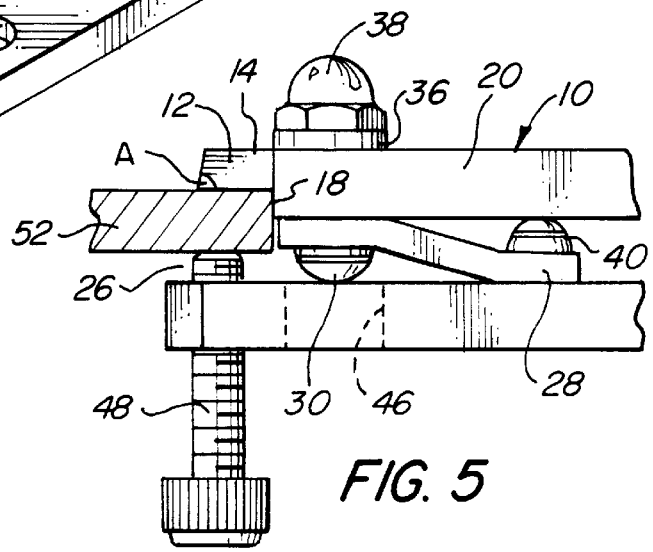
FIG. 5 is partial view of a cross section through a standard ice skate blade, with the deburring device of FIG. 1 in position to deburr the lateral edges of the blade.

Referring now to FIGS. 1 and 5, to remove burrs from ice skate blades after they are sharpened, the device 10 is placed over the blade 52 so that the blade 52 fits into the channel 26. The positioning screw 48 is tightened until the housing member 20 is substantially parallel to the base member 24 (illustrated in FIG. 5). The ice skate is placed on a table or other surface so that a portion of the blade 52 is resting on top of the table and the toe or heel of the skate is pressed against a side of the table. The device 10 is held by the housing member 20 between the thumb and index finger (as illustrated in FIG. 1). The skate is held securely against the table while pressure is applied to force the face of the blade 52 against the edge 18 of the housing member 20. The device 10 is reciprocated transversely of the blade 52 to remove lateral burrs (as illustrated by arrows in FIG. 1). Stone oil or another lubricant may be applied to the blade 52 to reduce friction and facilitate deburring.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A device for removing burrs along lateral edges of ice skate blades comprising:

a first rigid member;

a cutter having a face and at least one cutting surface extending from the face and defining a cutting edge, said cutter being operatively attached to said first rigid member;

a second rigid member;

a resilient means for connecting said first and second rigid members together such that a channel is defined by said second rigid member, said first rigid member and said cutter, said resilient means adapted to permit said first and second members to pivot relative to each other, and said channel having a width; and, a means for adjusting the width of the channel.

2. The device of claim 1 wherein:

said cutter comprises a cutting insert having a bottom surface, a top surface, and at least one cutting edge, the at least one cutting edge extending at an angle from the bottom surface to the top surface;

said first rigid member comprises a recess therein for receiving said cutting insert, the recess positioned such that the at least one cutting edge extends from an end of said first rigid member when said cutting insert is disposed in the recess.

3. The device of claim 2 further comprising a means for securing the cutting insert in the recess of said first rigid member.

4. The device of claim 2 wherein the channel is defined by a portion of said second rigid member, the end of said first rigid member having the recess and the bottom surface of said cutting insert.

5. The device of claim 4 wherein said means for adjusting the thickness of the channel comprises a positioning screw threaded through the portion of said second rigid member defining the channel such that tightening said positioning screw while a blade is disposed in the channel causes said first and second rigid members to pivot relative to each other.

6. A device for removing burrs along lateral edges of ice skate blades comprising:

a cutting insert having a bottom surface, a top surface, and at least one cutting surface, the cutting surface extending at an angle from the bottom surface to the top surface and defining a cutting edge;

a first rigid member having a recess therein for receiving said cutting insert, the recess positioned such that the at least one cutting edge extends from an end of said first rigid member when said cutting insert is disposed in the recess;

a means for securing said cutting insert in the recess of said first rigid member;

a second rigid member;

a resilient means for connecting said first and second rigid members together such that a channel is defined by a portion of said second rigid member, the end of said first rigid member having the recess and the bottom surface of said cutting insert, said resilient means adapted to permit said first and second members to pivot relative to each other; and, a positioning screw threaded through the portion of said second rigid member defining the channel such that tightening said positioning screw while a blade is disposed in the channel causes said first and second rigid members to pivot relative to each other.

7. The device of claim 6 wherein said cutting insert comprises a square bottom surface and a square top surface parallel to the bottom surface, the top surface having shorter sides than the bottom surface and positioned such that a cross section parallel to the top and bottom surfaces taken anywhere on said insert is square.

8. The device of claim 7 wherein the square bottom and top surfaces of the cutting insert have a diagonal, and wherein the recess in said first rigid member is positioned such that a plane defined by the end of said first rigid member is parallel to the diagonal of the square bottom and top surfaces of the cutting insert.

9. The device of claim 6 wherein said means for securing said cutting insert in the recess of said first rigid member comprises:

said first rigid member having a plurality of holes adjacent the recess;

a plurality of threaded screws passing through the plurality of holes; and, a plurality of washers disposed over said screws and a plurality of nuts engaging said plurality of screws such that said cutting insert is secured in the recess by said plurality of washers.

10. The device of claim 6 wherein said resilient means for connecting said first and second members together comprises:

at least one layer of resilient plastic material having a first set of a plurality of holes and a second set of a plurality of holes located at opposite ends thereof;

a first plurality of threaded screws passing through the first set of a plurality of holes in said at least one layer of resilient plastic material and anchored into said first rigid member; and, a second plurality of threaded screws passing through the second set of a plurality of holes in said at least one layer of resilient plastic material and anchored into said second rigid member.

11. The device of claim 6 wherein said resilient means for connecting said first and second members together and said means for securing said cutting insert in the recess of said first rigid member comprise:

at least one layer of resilient plastic material having a first set of a plurality of holes and a second set of a plurality of holes located at opposite ends thereof;

said first rigid member having a plurality of holes adjacent the recess;

a first plurality of threaded screws passing through the first set of a plurality of holes in said at least one layer of resilient plastic material and through the plurality of holes in said first rigid member;

a plurality of washers disposed over said first plurality of screws and a plurality of nuts engaging said first plurality of screws such that said cutting insert is secured in the recess by said plurality of washers; and, a second plurality of threaded screws passing through the second set of a plurality of holes in said at least one layer of resilient plastic material and anchored into said second rigid member.

12. A device for removing burrs along lateral edges of ice skate blades comprising:

a cutting insert having a bottom surface, a top surface, and at least one cutting edge, the cutting edge extending at an angle from the bottom surface to the top surface;

a first rigid member having a recess therein for receiving said cutting insert, the recess positioned such that the at least one cutting edge extends from an end of said first rigid member when said cutting insert is disposed in the recess, said first rigid member also having a plurality of holes adjacent the recess;

a plurality of threaded screws passing through the plurality of holes;

a plurality of washers disposed over said plurality of screws and a plurality of nuts engaging said plurality of screws such that said cutting insert is secured in the recess by said plurality of washers;

a second rigid member;

at least one layer of resilient plastic material having a first set of a plurality of holes and a second set of a plurality of holes located at opposite ends thereof for connecting said first and second rigid members together such that a channel is defined by a portion of said second rigid member, the end of said first rigid member having the recess and the bottom surface of said cutting insert, said at least one layer of resilient plastic material adapted to permit said first and second members to pivot relative to each other;

a first plurality of threaded screws passing through the first set of a plurality of holes in said at least one layer of resilient plastic material and anchored into said first rigid member;

a second plurality of threaded screws passing through the second set of a plurality of holes in said at least one layer of resilient plastic material and anchored into said second rigid member, and, a positioning screw threaded through the portion of said second rigid member defining the channel such that tightening said positioning screw while a blade is disposed in the channel causes said first and second rigid members to pivot relative to each other.

13. The device of claim 12 wherein said cutting insert comprises a square bottom surface and a square top surface parallel to the bottom surface, the top surface having shorter sides than the bottom surface and positioned such that a cross section parallel to the top and bottom surfaces taken anywhere on said insert is square.

14. The device of claim 13 wherein the recess in said first rigid member is positioned such that a plane defined by the end of said first rigid member is parallel to the diagonal of the square bottom and top surfaces of the cutting insert.

15. A device for removing burrs along lateral edges of ice skate blades comprising:

a cutting insert having a bottom surface, a top surface, and at least one cutting edge, the cutting edge extending at an angle from the bottom surface to the top surface;

a first rigid member having a recess therein for receiving said cutting insert, the recess positioned such that the at least one cutting edge extends from an end of said first rigid member when said cutting insert is disposed in the recess, said first rigid member also having a plurality of holes adjacent the recess;

a second rigid member;

at least one layer of resilient plastic material having a first set of a plurality of holes and a second set of a plurality of holes located at opposite ends thereof for connecting said first and second rigid members together such that a channel is defined by a portion of said second rigid member, the end of said first rigid member having the recess and the bottom surface of said cutting insert, said resilient means adapted to permit said first and second members to pivot relative to each other;

a first plurality of threaded screws passing through the first set of a plurality of holes in said at least one layer of resilient plastic material and through the plurality of holes in said first rigid member;

a plurality of washers disposed over said first plurality of screws and a plurality of nuts engaging said first plurality of screws such that said cutting insert is secured in the recess by said plurality of washers;

a second plurality of threaded screws passing through the second set of a plurality of holes in said at least one layer of resilient plastic material and anchored into said second rigid member; and, a positioning screw threaded through the portion of said second rigid member defining the channel such that tightening said positioning screw while a blade is disposed in the channel causes said first and second rigid members to pivot relative to each other.

16. The device of claim 15 wherein said cutting insert comprises a square bottom surface and a square top surface parallel to the bottom surface, the top surface having shorter sides than the bottom surface and positioned such that a cross section parallel to the top and bottom surfaces taken anywhere on said insert is square.

17. The device of claim 16 wherein the recess in said first rigid member is positioned such that a plane defined by the end of said first rigid member is parallel to the diagonal of the square bottom and top surfaces of the cutting insert.

18. A device for removing burrs along lateral edges of ice skate blades comprising:

a first member;

a cutter attached to said first member, said cutter having a face and at least one cutting surface extending from the face and defining a cutting edge;

a second member connected to said first member such that said first member and said second member are biased toward each other;

a channel defined by said second member, said first member and said cutter, said channel having a width, and said second member being connected to said first member such that said first member and second member are movable away from each other against the bias so that the width of the channel can be varied; and a means for adjusting the width of the channel.

19. The device of claim 18 wherein said means for adjusting the width of the channel comprises a positioning screw threaded through the portion of said second member defining the channel.

20. The device of claim 18 wherein said cutter comprises a cutting insert having a bottom surface, a top surface, and at least one cutting surface, the cutting surface extending at an angle from the bottom surface to the top surface and defining a cutting edge.

* * * * *